US005504293A

United States Patent [19]

Rogers et al.

[11] Patent Number: 5,504,293

[45] Date of Patent: Apr. 2, 1996

[54] OPERATING MECHANISM FOR ELECTRICAL SWITCHES AND FAULT INTERRUPTERS

[75] Inventors: Edward J. Rogers, Chicago; David H. Devonald, III, Green Oaks; Edmund S. Dizon, Chicago; Michael P. O'Dell, Oak Park, all of Ill.

[73] Assignee: S&C Electric Company, Chicago, Ill.

[21] Appl. No.: 225,213

[22] Filed: Apr. 8, 1994

[51] Int. Cl.[6] ..... H01H 33/42

[52] U.S. Cl. ..... 218/154; 74/100.1

[58] Field of Search ..... 200/144 R, 144 B, 200/148 R, 148 F, 400; 218/7, 14, 78, 84, 120, 140, 153, 154; 74/2, 100.1

[56] References Cited

U.S. PATENT DOCUMENTS 3,563,102 2/1971 Bernatt et al. ..... 74/100.1
3,845,433 10/1974 Kravlits ..... 335/254
4,293,834 10/1981 Date et al. ..... 335/76
4,484,046 11/1984 Neuhouser ..... 200/144 B
5,140,117 8/1992 Vianson ..... 200/400
5,224,590 7/1993 Milianowicz et al. ..... 200/400

*Primary Examiner*—J. R. Scott
*Attorney, Agent, or Firm*—James V. Lapacek

[57] ABSTRACT

An operating mechanism that provides multiple operational output states at a first output and additional operational output states at a second output that are synchronized with the first output to provide a predetermined sequence of control. The operating mechanism includes an output lever that is pivoted by the stored energy in a spring and latch levers that are selectively operated to release the output lever. When the output lever is moved between operational positions, the output lever is stopped in its pivoting movement via the latch levers.

5 Claims, 9 Drawing Sheets

GROUND
21
OPEN
CLOSED
40
50
52
108
92
100
81
42
54
56
58
76
49
62
43
118
70
72
74

OPERATING MECHANISM FOR ELECTRICAL SWITCHES AND FAULT INTERRUPTERS

BACKGROUND OF THE INVENTION

1. Field of the Invention

The present invention relates generally to a compact operating mechanism for a switchgear module and more particularly to a quick-make quick-break operating mechanism for electrical switches and fault interrupters that provides three operational output states at a first output point and a second output sequenced with the first output that has two operational states.

2. Description of Related Art

Various operating mechanisms for switches provide multiple operational states at an output corresponding to the desired operational states of the switch controlled by the mechanism. For example, U.S. Pat. No. 3,563,102 discloses a quick-make quick-break mechanism for operating a switch between open and closed positions. A manual switch operator for operating a vacuum interrupter and a series connected disconnect between two operating positions is disclosed in U.S. Pat. 4,484,046. The arrangement on closing, closes the disconnect switch before the vacuum interrupter, and on opening, opens the vacuum interrupter before the disconnect. An additional solenoid switch operator is coupled to the interconnection provisions between the manual switch operator and the vacuum interrupter for opening the vacuum interrupter through solenoid action. While this arrangement may be useful, it does not provide a compact operating mechanism for sequencing the operation of an interrupter with a disconnect in three operating positions. Further, the arrangement includes expansive linkages and toggle joints which are not desirable, not only from a mechanical design standpoint but also from the perspective of minimizing the size of switchgear modules that house the operator and the electrical components.

SUMMARY OF THE INVENTION

Accordingly, it is a principal object of the present invention to provide a compact and efficient operating mechanism for the operational control and sequencing of two different outputs.

It is another object of the present invention to provide an operating mechanism including multiple operational output states and a pivotal output member that is stopped in its movement by latch levers that are also utilized to release the output member. These and other objects of the present invention are achieved by an operating mechanism that provides multiple operational output states at a first output and additional operational output states at a second output that are synchronized with the first output to provide a predetermined sequence of control. The operating mechanism includes an output lever that is pivoted by the stored energy in a spring and latch levers that are selectively operated to release the output lever. When the output lever is moved between operational positions, the output lever is stopped in its pivoting movement via the latch levers.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
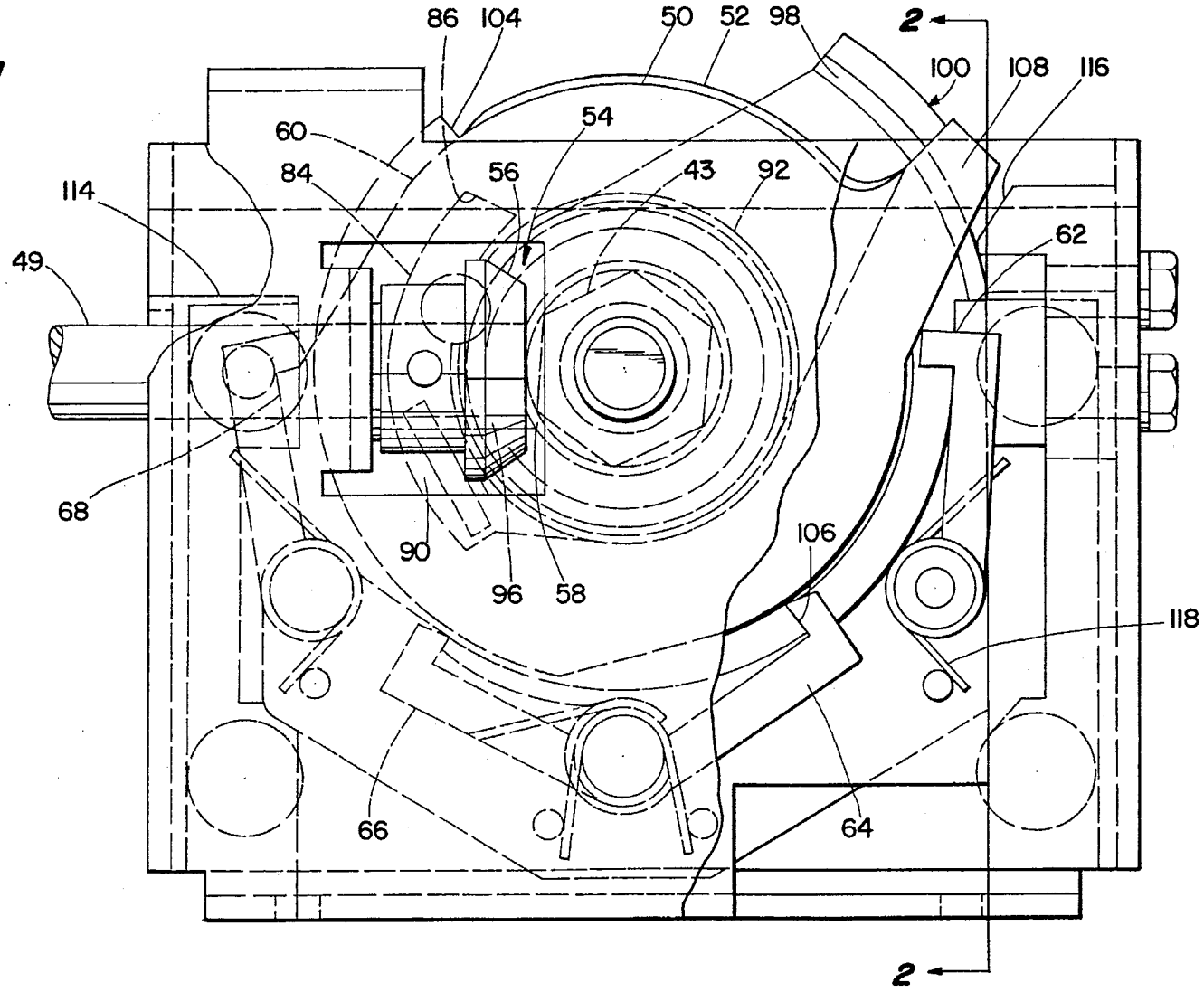
FIG. 1 is a front elevational view of an operating mechanism with parts cut away and removed for clarity.
Figure 2:
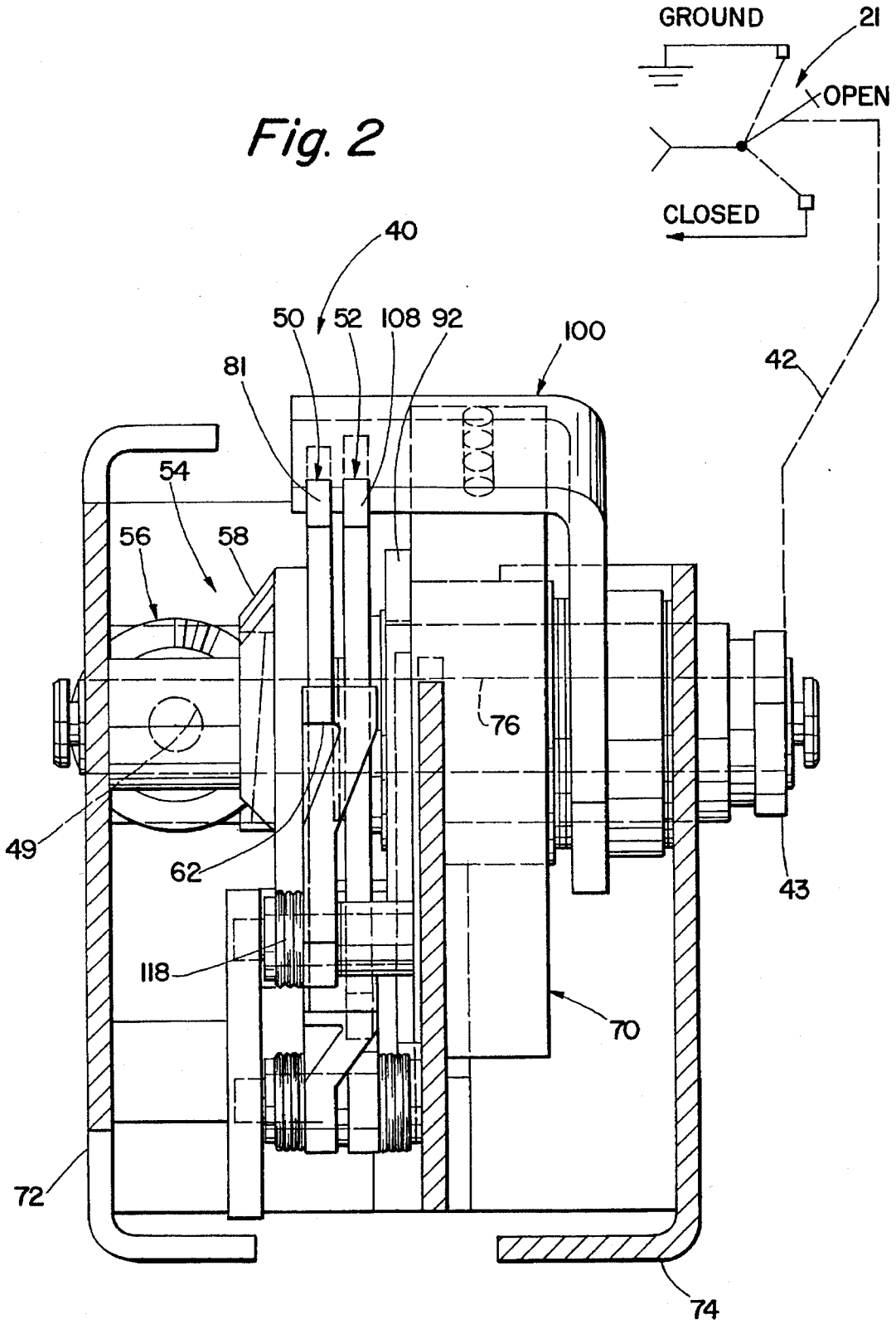
FIG. 2 is a sectional view taken along the line 2—2 of FIG. 1.
Figure 10:
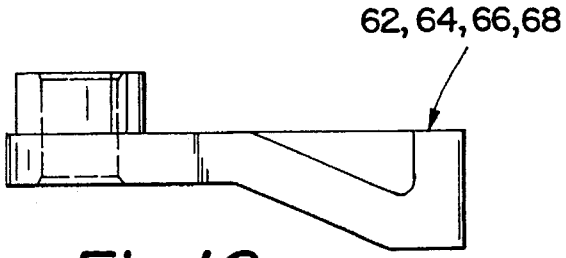
FIGS. 10 and 11 are respective front elevational and bottom plan views of a latch lever of the operating mechanism of FIGS. 1 and 2.

Referring now to FIGS. 1 and 2, an operating mechanism 40 in accordance with a specific embodiment of the present invention is of the general type shown in U.S. Pat. No. 3,563,102 and is suitable for use to operate the loadbreak switch 21 as more fully described in copending U.S. application Ser. No. 08/225,218 filed in the names of D. H. Devonald on Apr. 8, 1994. The loadbreak switch is operable between multiple operating positions, e.g. closed, open and grounded. In another specific embodiment, which will be discussed in more detail hereinafter in connection with FIGS. 13–24, the operating mechanism 200 is utilized to operate a disconnect switch 150 between multiple operating positions and additionally sequence the operation of a fault interrupter 23 that is connected in series with the disconnect switch 150 as described in the aforementioned copending application. Specifically, the fault interrupter is opened at the beginning of an operational cycle which then proceeds to additionally open the disconnect switch 150. Further, the fault interrupter 21 is closed during an operational cycle before the cycle proceeds to close the disconnect switch 150. The operating mechanism 200 also includes features to open the fault interrupter 23 in response to a trip input when a fault condition is detected, including the situation where the mechanism 200 closes the fault interrupter into a faulted condition via the series-connected disconnect switch 150.

Considering now the specific structure of the mechanism 40 in more detail and referring additionally now to FIGS. 3–12, the mechanism 40, which is shown in the closed position in FIGS. 1 and 2, includes a drive lever 50 and an output lever 52 which may also be referred to as a driven lever. The drive lever 50 is pivoted (rotated) via a gear drive arrangement 54 including a first bevel gear 56 that is rotatable by a charging/drive input 49 and a second bevel gear sector 58 fixed on the drive lever 50 and driven by the first bevel gear 56. The drive lever 50 also includes a cam surface 60 which is arranged to lift latch levers 62, 64, 66, and 68. The latch levers 62, 64, 66, and 68 are pivotally mounted and circumferentially arranged around the mechanism 40 at the appropriate points in the pivotal movement of the drive lever 50 to achieve the desired operation of the mechanism 40, i.e. to release the output lever 52 to pivot (rotate) in response to the stored energy in a spring 70. In accordance with important aspects of the present invention, the output lever 52 is stopped when moving between adjacent positions by a respective one of the latch arms 62, 64, 66, 68 after the desired drive output rotation is obtained at an output hub 43. The output hub 43 is fixed to a collar 110 attached to the output lever 52. In this manner, the multiple operating positions are achieved.

The mechanism 40 includes a frame provided by attached portions 72,74. The drive lever 50 is pivotably mounted on a mechanism shaft 76 carried by the frame. The drive lever 50 includes a circular periphery 80 with a radially extending arm 81. The eccentric cam surface 60 for operating the latch levers 62,64,66, and 68 includes two latch kick-out portions 83,85. The drive lever 50 also includes an arcuate slot 84 with ends 86,88 for receiving an extending tab 90 of a spring arbor 92 (best seen in FIGS. 6 and 7). The spring arbor 92 is generally in the shape of a collar and is pivotally carried about the shaft 76. The spring arbor 92 includes a split wall section 94 over which is hooked an inwardly turned end 96 of the spring 70. The second, outer end 98 of the spring 70 is secured to a spring guide 100 rotatably carried on the shaft 76. Thus, with the extending tab 90 of the spring arbor 92 against the end 88 of the slot 84 of the drive lever 50, rotation of the drive lever 50 from the input 49 stresses or charges the spring 70.

The output lever 52 includes a generally circular periphery 102 with generally diametrically opposed shoulders 104, 106 which function as latch stops and which divide the output lever 52 into areas of higher and lower radii 102*a*, 102*b* respectively. At approximately midway between the shoulders 104, 106 in the reduced radius region 102*b*, the output lever 52 includes a radially extending arm 108 similar to the arm 81 of the drive lever 50. The output lever 52 at its center is affixed to an output collar 110 that carries the operating hub 43. The output lever 52 also includes an arcuate slot 112 similar to the slot 84 of the drive lever 50, the slots 112, 84 being aligned in the operative end positions, e.g. ground and closed, with the extending tab 90 being received through the slot 112. Additionally, the radially extending arm 108 of the output lever 52 also stops against the spring guide 100.

Figure 11:
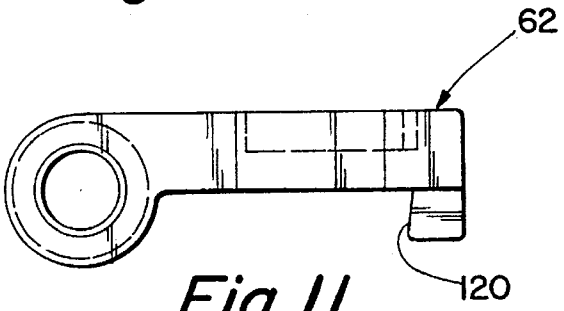
Figure 12:
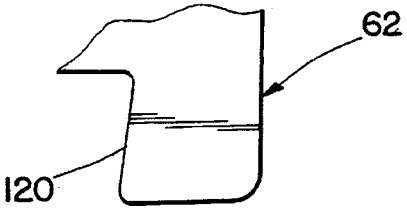
FIG. 12 is a partial view on an enlarged scale of the latch lever of FIG. 11.
Figure 3:
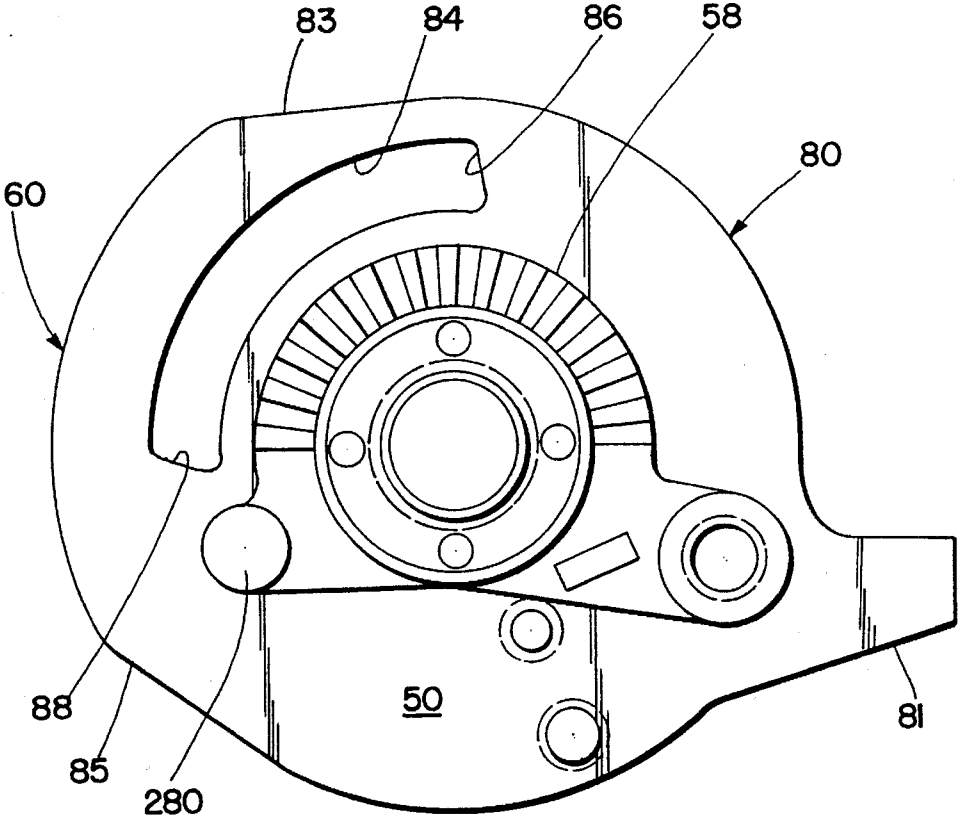
FIG. 3 is an elevational view of a drive lever of the operating mechanism of FIGS. 1 and 2.
Figure 5:
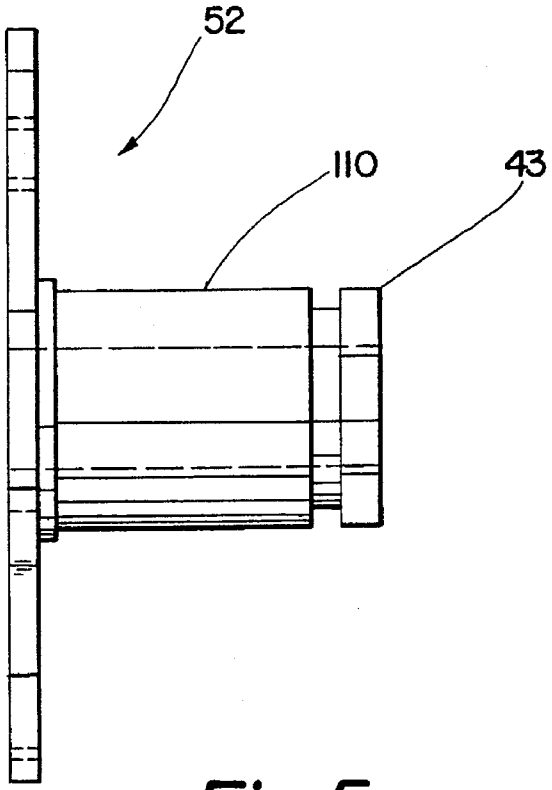
FIGS. 4 and 5 are respective front and right-side elevational view of an output lever of the operating mechanism of FIGS. 1 and 2.
Figure 4:
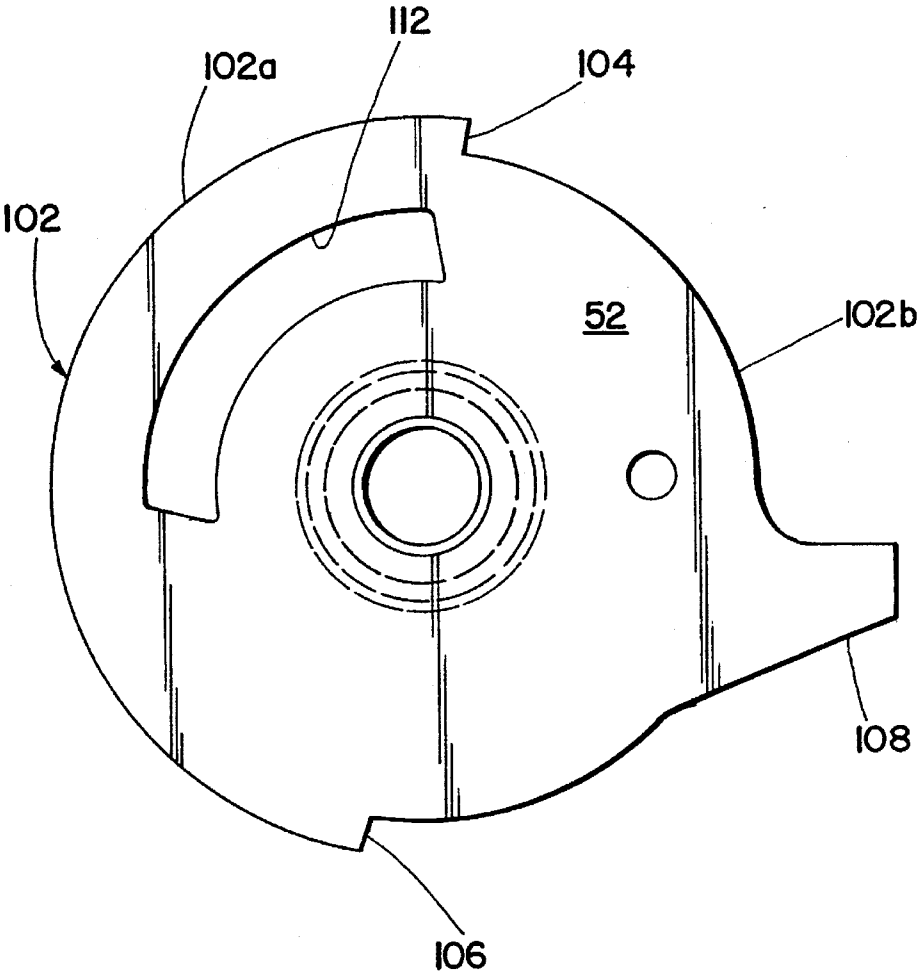
Figure 8:
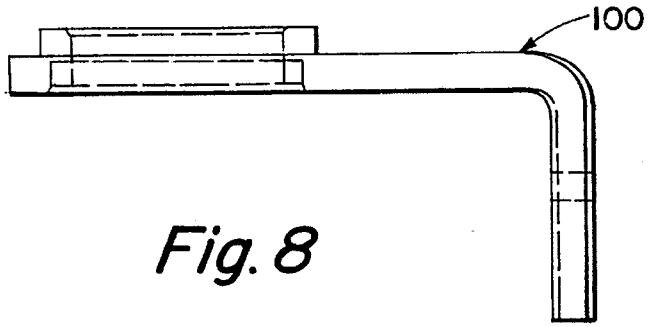
FIGS. 8 and 9 are respective front elevational and bottom plan views of a spring guide of the operating mechanism of FIGS. 1 and 2.
Figure 9:
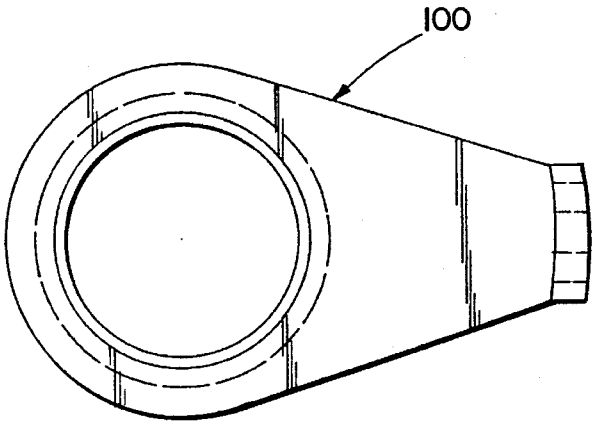
Figure 6:
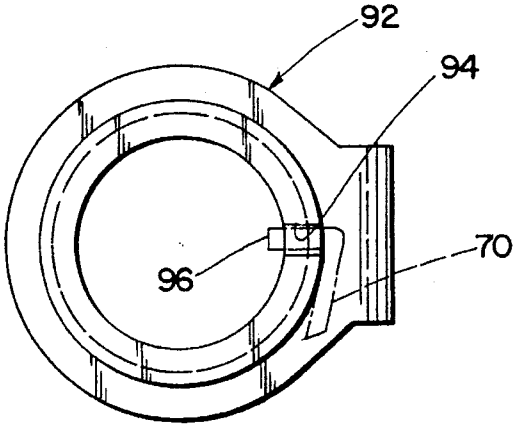
FIGS. 6 and 7 are respective front elevational and bottom plan views of a spring arbor of the operating mechanism of FIGS. 1 and 2.
Figure 7:
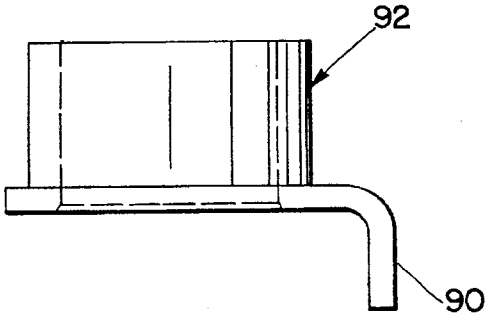

During operation, when the drive lever 50 is pivoted counterclockwise in FIG. 1 (i.e. from the closed position to the open position, or from the open position to the ground position), the arm 81 of the drive lever 50 acts against the spring guide 100 to charge the spring 70 while the output lever 52 is held by the latch arm (62 in the open position and 64 in the closed position). When the drive lever 50 is pivoted far enough such that the cam surface 82 lifts the latch arm (62 or 64), the output lever 52 is released to pivot counterclockwise in response to the tension in the spring 70. When driven into the open position, the output lever 50 is stopped from further pivoting by means of the latch arm 62 latching against the shoulder 106 of the output lever 52. When the output lever 52 is driven into the ground position, the output lever 52 pivots until the latch arm 64 latches against the shoulder 104, the spring guide 100 also encountering a stop 114 on the frame. Considering operation in the clockwise direction in FIG. 1 of the drive lever 50, i.e. driving the output lever 52 from the ground position to the open position or from the open position to the closed position, as the drive lever 50 moves clockwise, the spring 70 is charged as the inner end 96 is pivoted by the spring arbor 92 via the drive lever 50 acting against the tab 90 at the end 88 of the slot 84. In the ground position, the output lever 52 is held by the latch arm 66 which also prevents the spring guide 100 from moving as it acts against the arm 108 of the output lever 52. In the open position, the output lever 52 is held by the latch arm 68 and again the spring guide 100 is prevented from moving by the arm 108. As before, as the drive lever 50 pivots, the cam surface 84 at the appropriate position releases the operative latch arm (66 or 68), thus allowing the output: lever 52 to pivot clockwise, stopping in the open position as the latch arm 68 catches and latches the output lever 52, and stopping in the closed position as the latch arm 66 catches and latches the output lever 52, while the arm 108 also encounters a stop 116 on the frame. The latch arms 62, 64, 66, and 68 are biased toward the output lever 52 by springs, e.g. spring 118. The latch surface 120 of the latch levers 62, 64, 66, and 68 are shown in FIGS. 11 and 12.

Figure 13:
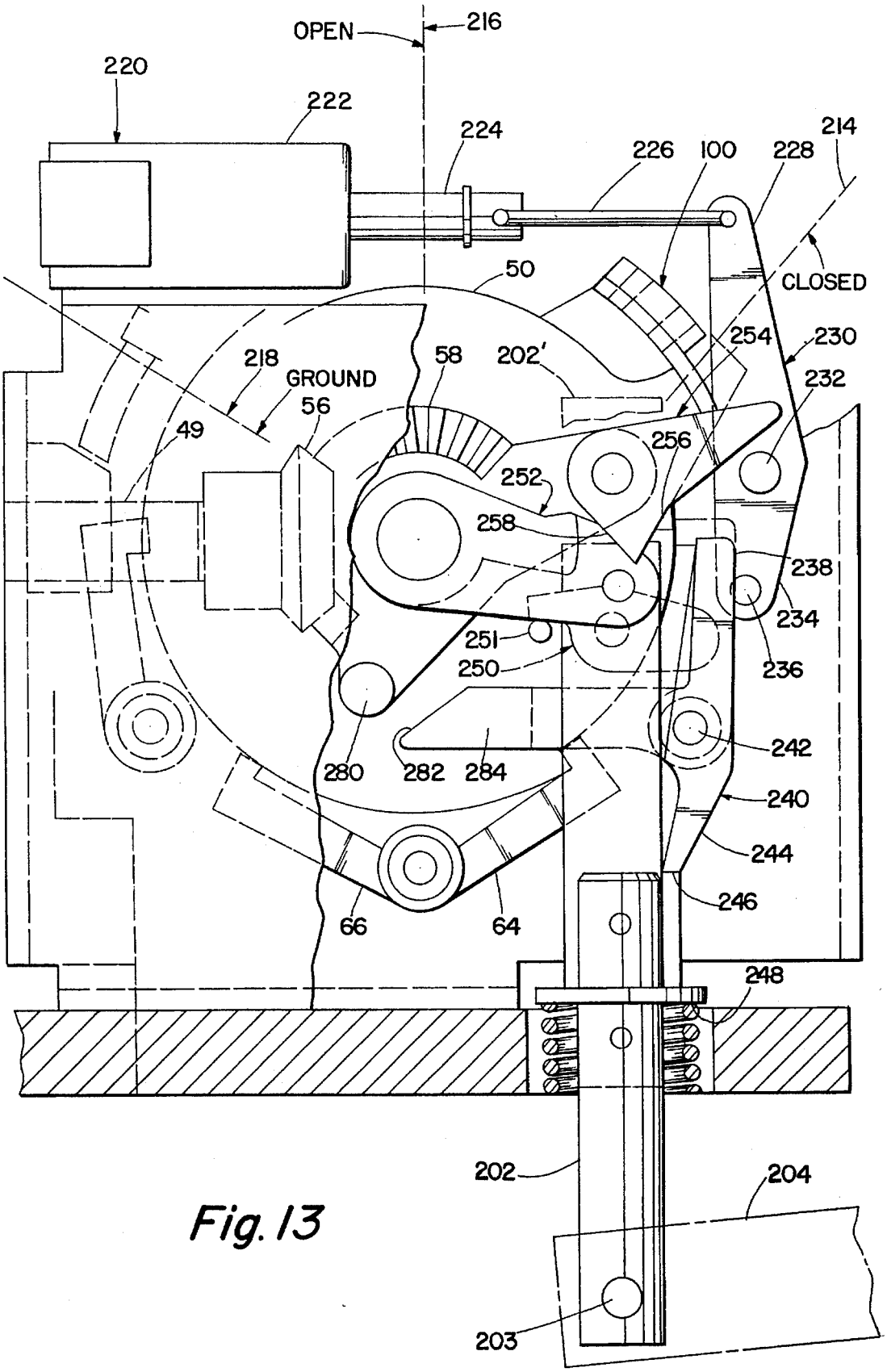
FIG. 13 is a front elevational view of another embodiment of an operating mechanism in accordance with the present invention with additional features to operate a fault interrupter.
Figure 14:
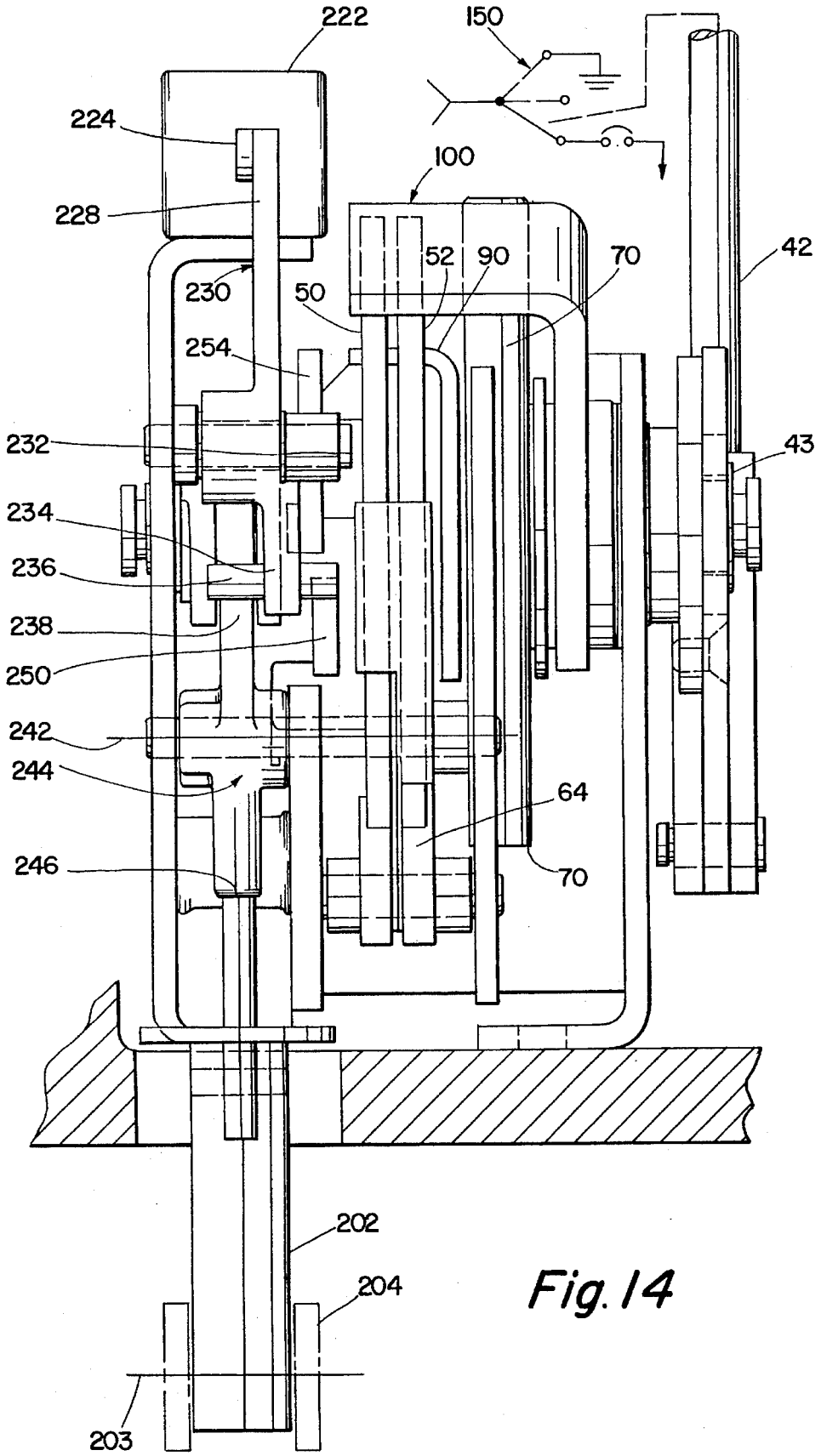
FIG. 14 is a right-side elevational view of FIG. 1 with parts removed and cut away.
Figure 15:
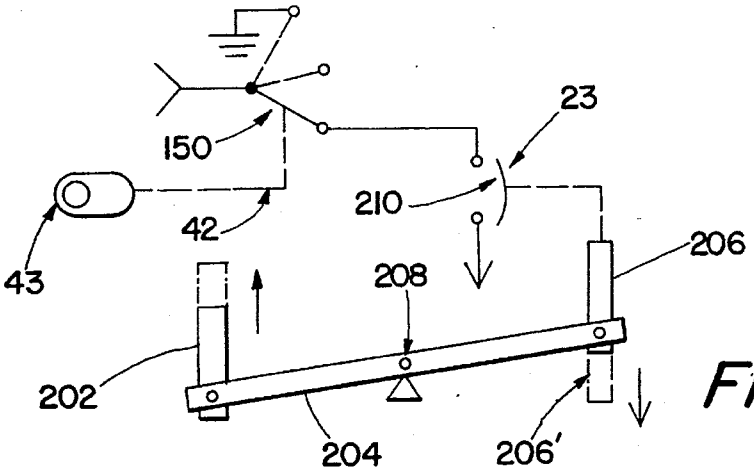
FIG. 15 is a diagrammatic representation illustrating the use of the operating mechanism of FIGS. 13 and 14 to operate a fault interrupter and a disconnect switch.

Referring additionally now to FIGS. 13–15 and considering the mechanism 200 to control the multiple positions of a disconnect switch 150 and the operation of a series-connected fault interrupter 23, the mechanism 200 is similar to the mechanism 40 and additionally includes features to sequence the operation of the fault interrupter 23 via the position of an operating member 202 which is connected at pin 203 to pivot one end of an operating link 204 pivotally supported at 208. The link 204 is arranged to operate the fault interrupter 23 via an operating rod 206 (FIG. 15) at the end of the link 204 on the other end of the pivot point 208. The operating rod 206 as shown in FIG. 15 is in an upper position corresponding to a closed, latched position of the fault interrupter 21, which corresponds to the lower position of the operating member 202 in FIGS. 13–14. The lower position of the operating rod 206 shown in phantom in FIG. 15 as 206', corresponds to an open position of the fault interrupter 21, which corresponds to the upper position of the operating member 202 shown in phantom in FIGS. 13 and 15 as 202'. The operating rod 206 is biased downwardly in FIG. 15 and the operating member 202 is biased upwardly (via spring 248 in FIG. 13 ) such that the operating member 202 must be latched in the lower position to hold the operating rod 206 of the fault interrupter 21 in the closed position, i.e., the operating member 202 when released being rapidly moved to the upper position and the operating rod 206 moving to the lower position where the fault interrupter 23 is open.

The mechanism 200 (shown in the closed position in FIGS. 13 and 14) is arranged to sequence the fault interrupter into the closed position by moving the operating member 202 into the lower, latched position during the operational cycle from the opened to closed positions and before the switch 150 is closed, i.e. the fault interrupter 23 is latched closed via member 202 as the drive lever 50 is being pivoted (clockwise in FIG. 13) to charge the spring 70 such that the fault interrupter 23 is closed before the disconnect switch 150 is closed via the pivoting of the output hub 43. Similarly, when the mechanism 200 is operated from the closed to the open positions for the disconnect switch 150, as the drive lever 50 is pivoted (counterclockwise in FIG. 13) to charge the spring 70, the operating member 202 is released and moves to the upper position and the fault interrupter is allowed to open before the operating hub 43 is pivoted to move the disconnect switch 150 out of the closed position and into the open position. Additionally, with the fault interrupter 23 in the closed position, the mechanism 200 is responsive to a trip signal at 220 (e.g. in response to a detected fault condition by a relay or the like, not shown) to release the operating member 202 to move to the upper position and allow the fault interrupter 23 to open.

Figure 17:
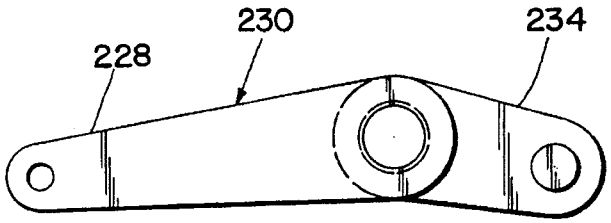
FIGS. 16 and 17 are respective top plan and front elevational views of a trip lever for use in operating portions of the operating mechanism of FIGS. 13 and 14.
Figure 16:
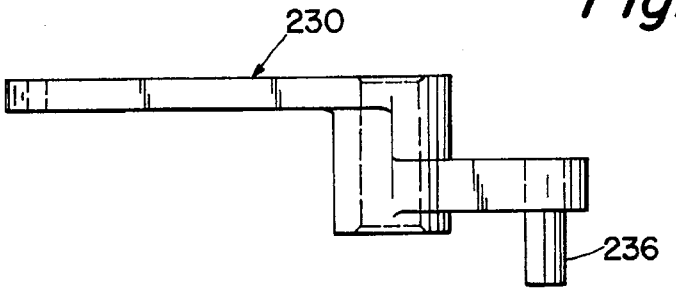
Figure 19:
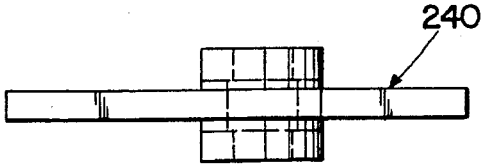
FIGS. 18 and 19 are respective from elevational and top plan views of a latch arm of the operating mechanism of FIGS. 13 and 14.
Figure 18:
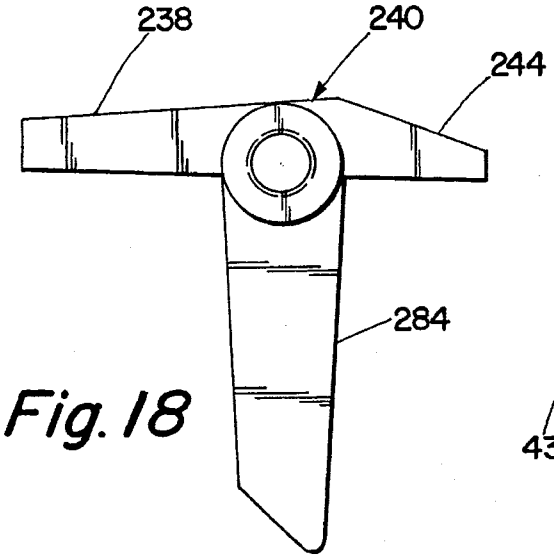
Figure 23:
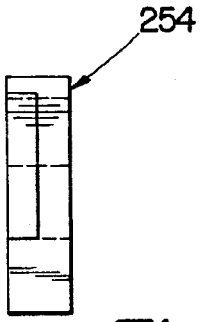
FIGS. 22 and 23 are respective front and right-side elevation views of a charging lever used to move the lever of FIGS. 20 and 21.
Figure 22:
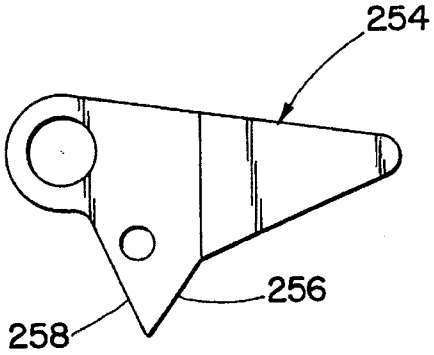
Figure 24:
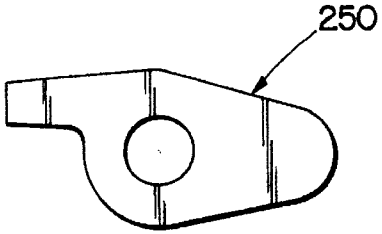
FIG. 24 is a front elevational view of a pawl of the operating mechanism of FIGS. 13 and 14.
Figure 21:
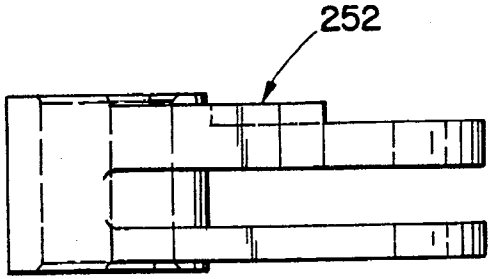
FIGS. 20 and 21 are respective front elevational and top plan views of a lever used for operating portions of the operating mechanism of FIGS. 13 and 14.
Figure 20:
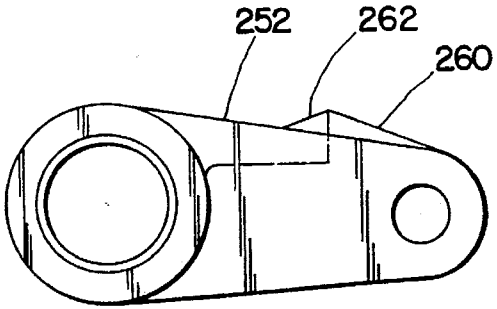

With additional reference now to FIGS. 16–24 and considering the specifics of how these functions are accomplished, first consider a trip operation responsive to the detection of a fault. The trip signal at 220 operates a solenoid 222 so as to rapidly move a plunger 224 of the solenoid 222 to the right in FIG. 13. A link 226 connected to the plunger 224 is connected at one end 228 of an operating lever 230 (FIGS. 16–17). The operating lever 230 is pivotally mounted at 232. The operating lever 230 at a second end 234 includes an extending pin 236 that is arranged to contact a first end 238 of a trip/latch lever 240 (FIGS. 18–19). The trip/latch lever 240 is pivotally mounted at 242 and includes a latch arm 244 on the opposite side of the pivot point 242 from the end 238, the latch arm 244 latching the operating bar 202 at a shoulder 246. When the solenoid 222 is operated, the operating lever 230 pivots clockwise in FIG. 13 which then pivots the trip/latch arm 240 counterclockwise releasing the operating bar 202, the operating bar 202 being released to move upwardly under the bias of the spring 248 and the downwardly biased operating rod 206. The operating rod 206 moving down opens the contacts 210 of the circuit interrupter 23. The fault interrupter 23 remains open and the bar 202 remains in the upper position when the mechanism 200 is operated to open the switch 150. When the mechanism 200 is operated to close the switch 150, before the output lever 52 is released, upon clockwise pivoting of the drive lever 50, the solenoid 222 is recocked via a pawl 250 contacting the pin 236 and pivoting the operating lever 230 so as to move the link 226 and the solenoid plunger 224 to the left in FIG. 13, recocking the solenoid 222 so as to be ready for another tripping operation. The pawl 250 is biased in a counterclockwise sense against a pin 251. As the drive lever 50 continues pivoting clockwise toward the closed position 214, a lever 252 (FIGS. 20–21) that is pivotally mounted with respect to the frame and pinned at the top of the bar 202, is contacted and pivoted by a charging lever 254 (FIGS. 22–23). The charging lever 254 is pivotally mounted on the drive lever 50 and is biased in a clockwise sense. The charge lever 254 includes camming surfaces 256 and 258 that work against the camming surfaces 260 and 262 so as to pivot the lever 252 and the bar 202 downward against the biasing forces. This moves the bar 202 to the lower position to close or latch the fault interrupter 23.

Considering now the operation of the mechanism 200 to open the fault interrupter 23 via the drive input 49, as the drive lever 50 begins to pivot counterclockwise from the closed position 214 and toward the open position 216, a pin 280 extending from the drive lever 50 is arranged to contact an angled edge 282 of an extending arm 284 of the trip/latch lever 240 so as to pivot the lever 240 counterclockwise, releasing the bar 202 to open the fault interrupter 23.

While there have been illustrated and described various embodiments of the present invention, it will be apparent that various changes and modifications will occur to those skilled in the art. For example is should be realized that the operating mechanism of the present invention can be utilized to control the sequenced operation of a variety of components. Accordingly, it is intended in the appended claims to cover all such changes and modifications that fall within the true spirit and scope of the present invention.

What is claimed and desired to be secured by Letters Patent of the United States is:

1. Apparatus comprising:

drive means pivotally mounted with respect to a predetermined pivot axis and being pivoted in response to a drive input;

a spiral spring coaxial with said predetermined pivotal axis, said spiral spring having a first end coupled to said drive means;

output member means pivotally mounted about said predetermined axis and arranged to be acted upon by a second end of said spiral spring when said spiral spring is tensioned;

first means for stopping, latching and selectively releasing said output member means, said first means comprising at least four movable latch members that are biased in a predetermined manner with respect to said output member means and stop means for defining at least two spaced apart latch positions of said output member means that cooperate with said at least four movable latch members, said output member means and said at least four movable latch members being configured to define at least three predetermined operating positions for said output member means, said at least three predetermined operating positions being defined by the placement of said at least four movable latch members with respect to said output member means, said first means further comprising a cam movable with said drive means and including a predetermined cam surface for selectively releasing each of said at least four movable latch members at a respective predetermined position of said cam, whereby pivoting of said drive means tensions said spiral spring so as to exert force to pivot said output member means, said output member means being released for pivot movement upon each of said at least four movable latch members being selectively released.

2. The apparatus of claim 1 wherein said output member means comprises an output lever that is pivotally mounted in said apparatus.

3. The apparatus of claim 1 wherein said output member means comprises an output lever having a surface perimeter that includes abrupt changes at predetermined positions that cooperate with said movable latch members.

4. The apparatus of claim 3 wherein said output member includes a generally curved peripheral portion with defined shoulders.

5. The apparatus of claim 1 further comprising second output means including a second output member and being responsive to said drive means for moving said second output member between first and second predetermined positions prior to said output member means being moved, and means for operating said second output member independently of said output member means and without movement of said output member means.

* * * * *